United States Patent [19]

Gauthier

[11] Patent Number: 4,719,139

[45] Date of Patent: Jan. 12, 1988

[54] PAPERMAKER'S FABRIC CONSTITUTED BY PLASTIC SPIRALS

[75] Inventor: Maurice Gauthier, Hiersac, France

[73] Assignee: COFPA Feutres pour Papeteries, France

[21] Appl. No.: 811,509

[22] Filed: Dec. 20, 1985

Related U.S. Application Data

[63] Continuation of Ser. No. 715,195, Mar. 22, 1985, Pat. No. 4,567,077, which is a continuation of Ser. No. 403,733, Jul. 14, 1982, abandoned.

[30] Foreign Application Priority Data

Nov. 14, 1980 [FR] France ..... 80 24221

[51] Int. Cl.[4] ..... D21F 1/10; F26B 13/08

[52] U.S. Cl. ..... 428/114; 139/383 A; 139/425 A; 162/348; 162/DIG. 1; 198/851; 198/853; 428/132; 428/222

[58] Field of Search ..... 139/383 A, 425 A; 162/348, DIG. 1; 198/851, 853; 428/114, 132, 222

[56] References Cited

U.S. PATENT DOCUMENTS

| | | | |
|---|---|---|---|
| 2,621,779 | 12/1952 | Harter | 198/853 |
| 2,740,615 | 4/1956 | Scholl | 198/844 X |
| 4,186,566 | 2/1980 | AuYoung | 62/380 |
| 4,308,897 | 1/1982 | Westhead | 139/383 A |
| 4,567,077 | 1/1986 | Gauthier | 428/422 |

FOREIGN PATENT DOCUMENTS

| | | |
|---|---|---|
| 2419751 | 8/1978 | Fed. Rep. of Germany . |
| 2489794 | 12/1982 | France . |
| 28861 | 9/1980 | United Kingdom . |

OTHER PUBLICATIONS

Patent application No. 28,861, filed Sep. 1980, and apparently unpublished.

*Primary Examiner*—James C. Cannon
*Attorney, Agent, or Firm*—Benasutti and Murray

[57] ABSTRACT

A conveyor belt such as a paper-making fabric, said belt being made of spirals (2, 3) assembled together by rods (5) or by imbrication. With a view to reducing the permeability or to changing the surface condition, it has a generally flat member (7) which is inserted inside the spirals (2, 3) so as to completely or partially fill the spaces between or inside the spirals.

10 Claims, 7 Drawing Figures

PAPERMAKER'S FABRIC CONSTITUTED BY PLASTIC SPIRALS

This application is a continuation of pending U.S. patent application Ser. No 715,195, filed on Mar. 22, 1985, now U.S. Pat. No. 4,567,077, which is in turn a continuation of U.S. patent application Ser. No. 403,733, filed on July 14, 1982 (now abandoned) and claims priority from PCT Application No. PCT/FR81/00146, filed Nov. 19, 1981 and from French Patent Application No. 80/22241, filed on Nov. 14, 1980.

FIELD OF THE INVENTION

The present invention relates to a conveyor belt constituted by spirals and used in paper-making, said spirals being linked together with flat bars being inserted in the spirals to reduce the permeability or change the surface condition of the conveyor belt.

BACKGROUND OF THE INVENTION

The advantage of conveyor belts constituted by spirals is that firstly, they greatly withstand the ingress of dirt since their structure is a smooth, open, monofilament structure and secondly, they withstand flattening, this imparting thereto constant permeability to fluids (in particular air) which would otherwise pass therethrough.

Due to these very advantageous features, such conveyor belts are used in paper-making machines in which, when drying sheets of paper, water vapour is removed which must pass through the conveyor belt.

To properly dry the paper, it is necessary for the permeability to air of the conveyor belt to remain constant.

However, in rapid-operation machines which manufacture ordinary paper, a large boundary layer of air is entrained by the conveyor belts and greatly disturbs the conveying of a sheet from one drying cylinder to another.

To remedy said drawback, it is known to reduce conveyor belt permeability by inserting flat bars inside the spirals. Such a conveyor belt is described e.g. in German Pat. No. 265,673.

The drawback of such a conveyor belt is that after being used for some time, ingress of dirt therein is excessive.

Indeed, impurities are deposited on the bars and in particular along their edges, thereby reducing the permeability of the conveyor belt.

SUMMARY OF THE INVENTION

To remedy said drawback, conveyor belts in accordance with the invention have flat bars which have holes sufficiently large to prevent excessive ingress of dirt.

The dimensions and the spacing of the holes depends on the permeability required.

With conveyor belts in accordance with the invention, conveyor belt permeability can be set at a determined level and remain constant.

The invention is described hereinbelow in greater detail with reference to a particular embodiment given by way of a non-limiting illustration as in the accompanying drawings.

DESCRIPTION OF THE PREFERRED EMBODIMENTS

Figure 1:
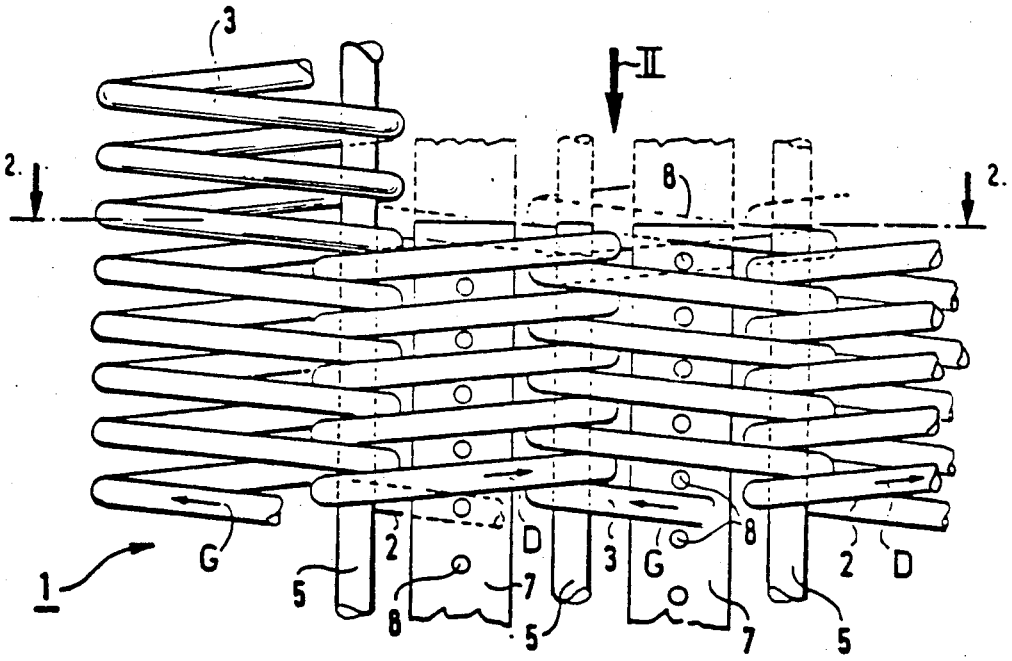
FIGS. 1 and 2 are, respectively, a plan and a sectional view taken about line 2—2 of FIG. 5 arrow II in FIG. 1, of a preferred embodiment of a conveyor belt in accordance with the invention, in which the spirals are assembled together by rods.
Figure 2:
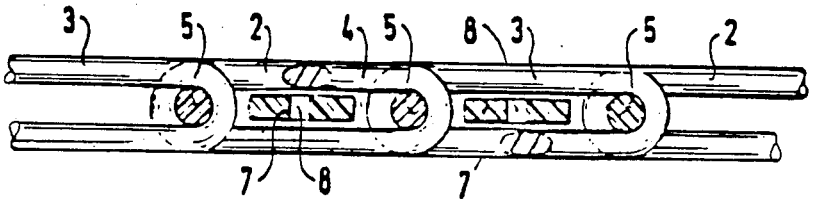

In the embodiment illustrated in FIGS. 1 and 2, a conveyor belt 1 is constituted by spirals 2 and 3 disposed in the transversal direction relative to the longitudinal axis of the conveyor belt. These spirals 2 and 3 whose turns are respectively inclined alternately to the right as shown by the arrow D and to the left as shown by the arrow G are assembled by connection rods 5 made for example of a synthetic material.

Inside the spiral 2, in the passage 4 left free between the adjacent spirals 3, a bar 7 made of a plastics substance and whose general shape is flat serves to fill in the inside of said passage 4. The length of the bar 7 is preferably equal to the width of the conveyor belt 1. Filling in the spirals of the fabric reduces the permeability of the conveyor belt and modifies the surface condition of the conveyor belt; this makes it possible to reduce marking. The plastic bars in the conveyor belt improve the surface condition of the conveyor without increasing the transfer of moisture and ingress of dirt, thus avoiding the drawbacks which would ensue: chemical deterioration of the fabric and clogging up of the conveyor belt and hence frequent removal of the conveyor belt.

Figure 6:
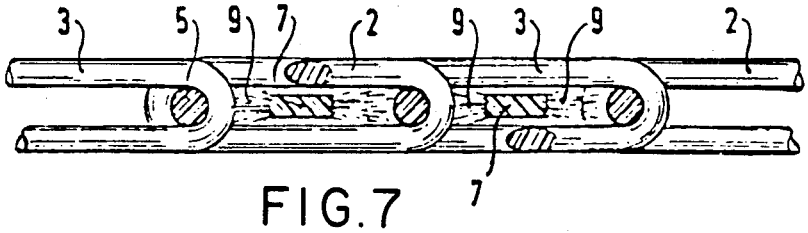
FIG. 6 illustrates another embodiment of the papermaker's fabric wherein the synthetic filler bars have flocked edges.
Figure 7:
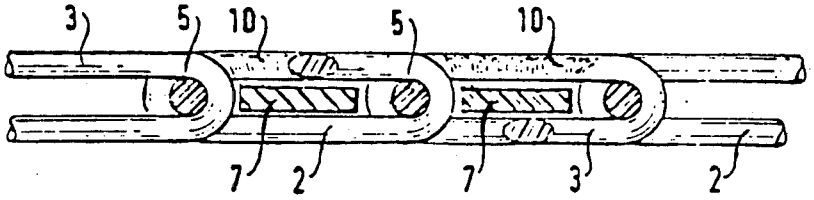
FIG. 7 illustrates another embodiment of the papermaker's fabric wherein the synthetic filler bars have at least one flocked surface.

In some variants, the bar 7 may have a variable constitition. For example, it may be made of a laminated substance and be reinforced with fibres or made of metal, plasticized metal with a metal core reinforced with resin. As shown in FIGS. 6 and 7, it may be flocked with synthetic fibres on one or both surfaces and/or on both edges. Flocking can be effected by glueing fibres on a support subjected to an electrostatic field. It is thus possible to improve the surface condition of the conveyor belt and to reduce its permeability.

With a view to varying the permeability of the conveyor belt and the surface condition thereof, the bars 7 have holes 8. By choosing the shape hole, the density and the cross-section, the required permeability can be obtained.

The holes always have a cross-section which is sufficient to prevent the bars from being crushed.

Figure 3:
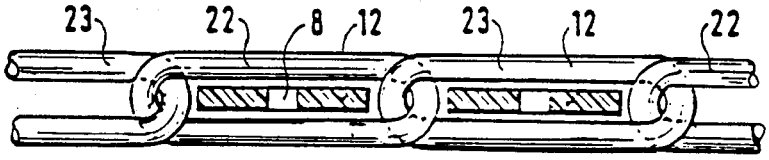
FIG. 3 illustrates a variant in which the spirals are imbricated together by their turns.

FIG. 3 illustrates a conveyor belt constituted by spirals 22, 23 disposed transversally and having inbricated turns which are not fixed together by connecting rods. Flat plastic bars 12 are passed through the spirals 22, 23. These bars can be identical to those used in the case of conveyor belts with spirals assembled together by rods. They are provided with holes 8 which pass through the bar 12 and allow the required permeability to be obtained.

The bar 4 provided with perforations can be replaced by bars provided with notches 11 which are disposed along one edge of the bar.

Figure 4:
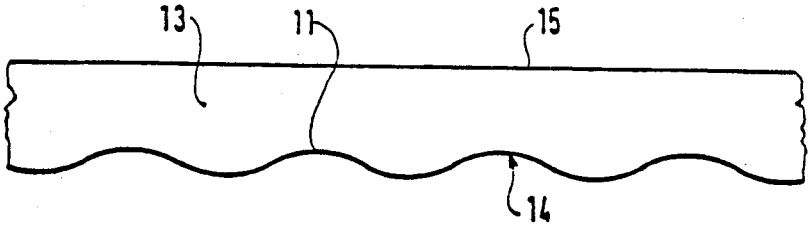
FIGS. 4 and 5 illustrate variants of bars.
Figure 5:
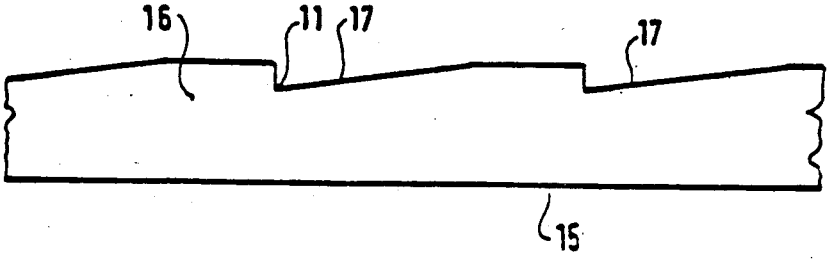

Two examples of such bars are illustrated in FIGS. 4 and 5.

FIG. 4 shows a section bar 13 of variable width which has a straight edge 13 and a corrugated edge 14 with notches 11 in it.

FIG. 5 illustrates an embodiment of a bar 16 with a straight edge 13 and an edge with inclined notches 17 so as to impart an increasing and decreasing width so as to allow an increase in the permeability at some points of the conveyor belt.

I claim:

1. In a papermaker's fabric comprising a plurality of transverse synthetic spirals connected together serially to define a supporting surface for transporting a paper web through papermaking machinery, said supporting surface having a predetermined permeability, the improvement comprising:

at least one generally flat synthetic bar disposed within each of said spirals such that a desired reduction in the permeability of said papermaker's fabric is achieved.

2. A papermaker's fabric according to claim 1 wherein each synthetic bar is disposed within only one of said spirals.

3. A papermaker's fabric according to claim 2 wherein:

said synthetic bars are flocked with synthetic fibers on at least one side.

4. A papermaker's fabric according to claim 2 wherein:

said synthetic bars are flocked with synthetic fibers on both edges.

5. In a papermaker's fabric comprising a plurality of transverse synthetic spirals connected together serially to define a sporting surface for transporting a paper web through papermaking machinery, said supporting surface having a predetermined permeability, the improvement comprising:

at least one generally flat synthetic bar being selectively flocked with synthetic fibers disposed within each of said spirals such that a desired reduction in the permeability of said papermaker's fabric is achieved.

6. A papermaker's fabric according to claim 5 wherein each selectively flocked synthetic bar is disposed within only one of said spirals.

7. A papermaker's fabric according to claim 5 wherein said synthetic bars are flocked along the edges thereof such that a desired reduction in the permeability of said papermaker's fabric is achieved.

8. A papermaker's fabric according to claim 5 wherein:

said synthetic bars are flocked on at least one side thereof such that said flocking extends through said spirals to the paper web supporting surface defined by said papermaker's fabric.

9. In a papermaker's fabric comprising a plurality of transverse synthetic spirals connected together serially to define a supporting surface for transporting a paper web through papermaking machinery, the improvement comprising:

filler means comprising generally flat synthetic bars disposed within each of said spirals such that a desired reduction in the permeability of said papermaker's fabric is achieved.

10. A papermaker' fabric according to claim 9 wherein:

said filler means further comprises flocking along the edges of said flat synthetic bars and upon at least one surface of said flat synthetic bars.

* * * * *